United States Patent [19]

Burns

[11] 4,382,409

[45] May 10, 1983

[54] LONGITUDINAL REINFORCEMENT OF HIGH EXPLOSIVE FILL IN PROJECTILES

[75] Inventor: Bruce P. Burns, Churchville, Md.

[73] Assignee: The United States of America as represented by the Secretary of the Army, Washington, D.C.

[21] Appl. No.: 202,221

[22] Filed: Oct. 30, 1980

[51] Int. Cl.[3] ..... C06D 5/00

[52] U.S. Cl. ..... 102/289; 102/291; 102/478; 102/479

[58] Field of Search ..... 102/289, 478, 479, 291

[56] References Cited

U.S. PATENT DOCUMENTS

| | | | |
|---|---|---|---|
| 772,346 | 10/1904 | Emery | 102/478 |
| 3,035,950 | 5/1962 | Long | 102/289 X |
| 3,664,133 | 5/1972 | Iwanciow et al. | 102/289 X |
| 3,749,615 | 7/1973 | Dorsey, Jr. et al. | 102/289 X |
| 3,811,380 | 5/1974 | Glass | 102/289 X |
| 3,822,645 | 7/1974 | Alexander | 102/289 X |
| 3,898,934 | 8/1975 | Mercier et al. | 102/289 X |

FOREIGN PATENT DOCUMENTS

| | | | |
|---|---|---|---|
| 10830 | of 1891 | United Kingdom | 102/479 |

*Primary Examiner*—Peter A. Nelson

*Attorney, Agent, or Firm*—Nathan Edelberg; Robert P. Gibson; A. Victor Erkkila

[57] ABSTRACT

Longitudinal stresses in the explosive grain of a rapidly accelerated high explosive projectile are absorbed in longitudinal reinforcement members and are transferred therefrom to the casing of the projectile. Transmission of the acceleration load from the grain to the longitudinal reinforcement members may be by friction, adhesive bonding or by area mismatch. A stress decoupling layer in the aft end of the projectile may be employed for matrix stress decoupling.

3 Claims, 4 Drawing Figures

FIG. 1
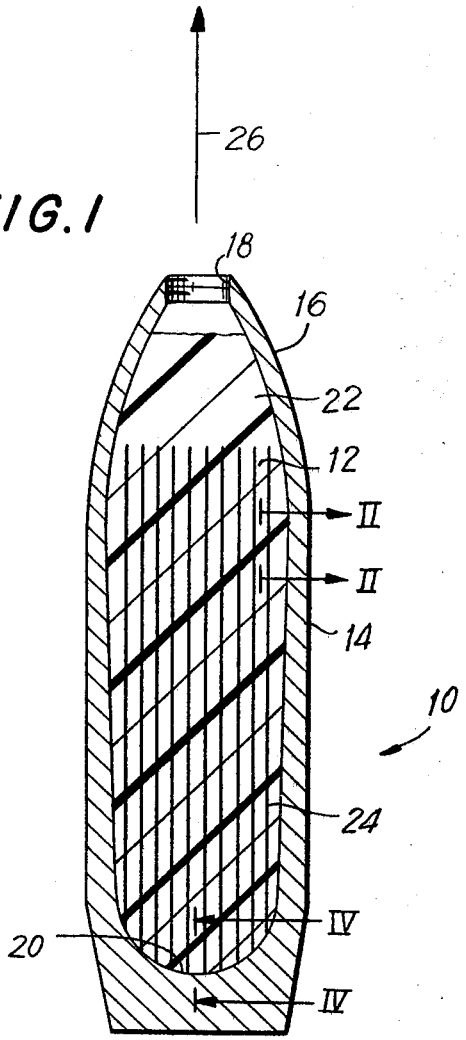
FIG. 2
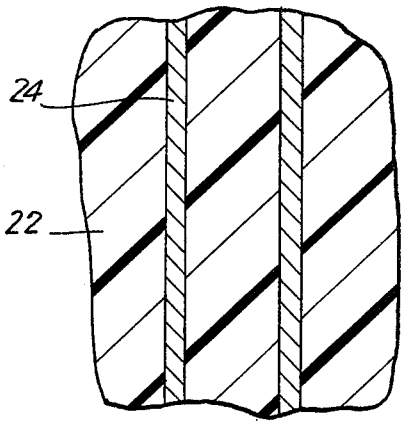
FIG. 3
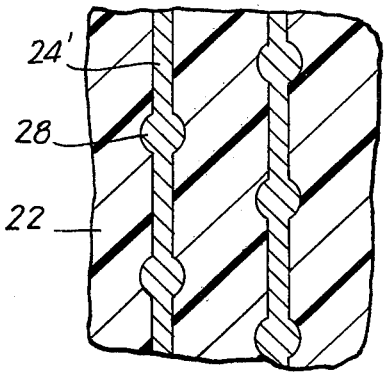
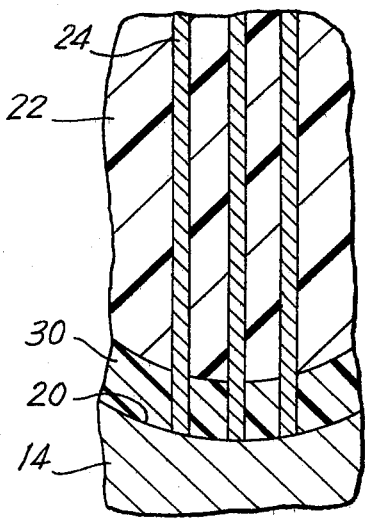
FIG. 4

LONGITUDINAL REINFORCEMENT OF HIGH EXPLOSIVE FILL IN PROJECTILES

GOVERNMENTAL INTEREST

The invention described herein may be manufactured, used and licensed by or for the Government for governmental purposes without the payment to us of any royalties thereon.

BACKGROUND OF THE INVENTION

The present invention relates to high explosive grain fill in projectiles and, more particularly, to apparatus for preventing the premature detonation of such high explosive fill due to peak acceleration during launch of the projectile.

High explosive projectiles, and particularly gun-launched high explosive filled projectiles experience exceedingly high peak accelerations during launch thereof. These accelerations are sufficient under some circumstances to cause premature explosion in the bore of the gun.

Such premature explosions are believed to be caused by the presence of high axial stress in the high explosive grain, possibly coupled with lateral or radial acceleration due to spin.

The tendency to premature explosion is believed to be increased by the use of more sensitive (and more powerful) explosive such as Composition B instead of TNT. Other causes of premature explosion may include defects in the explosive grain in the presence of large stresses, gaps between the high explosive grain and the body at the rear of the projectile which become compressed by large deformation of the explosive grain due to the high stresses and forces during firing, and both axial and torsional slip between the side wall of the shell body and the high explosive grain.

Although the above failure mechanisms are believed by the inventor to be factors in producing premature explosion of high explosive grain in gun-fired projectiles, it should not be assumed either that this list is exhaustive nor that the present invention is limited by the above noted theories.

Possible methods of avoiding premature explosion may include the use of less sensitive explosives, for example, the use of TNT rather than the more powerful and sensitive Comp B. This solution reduces the lethality and effectiveness of the explosive charge. Another possible solution is to limit the acceleration at which the projectile can be fired. This, of course, results in reduced range capability of the weapon system. Premature explosion from faults in the explosive grain may also be, in theory, avoided by greater care in manufacture and casting of the explosive grain in the projectile casing. Although this method may be used in research and exploratory development activities, it is probably too expensive in a normal production environment. A further possibility is to bond the grain to the casing in order to cause the axial setback force in the high explosive grain to be transmitted to the body of the projectile due to the large mismatch in modulus of the two materials. The effectiveness of such glue bonding is limited by aging effects of the glue itself as well as deleterious effects on the bonding due to thermal cycling and mishandling during long storage. In addition, undesired chemical reactions may take place between the high explosive grain and the components of the glue. These undesired effects of glue bonding may lead to cracking of the explosive grain either from residual manufacturing stresses or thermal and mechanical stresses during temperature cycling caused by the mismatch in bulk thermal expansion coefficient between the high explosive grain and the steel projectile body. Thus actual or incipient failure of the glue bond prior to firing may still cause premature detonation. Furthermore, such potential for premature high explosive grain detonation also may present a hazard during accidental drops of the projectiles during handling.

OBJECTS AND SUMMARY OF THE INVENTION

It is an object of the present invention to provide a high explosive grain more resistant to premature explosion.

It is a further object of the invention to provide a reinforced high explosive grain wherein longitudinal reinforcement members absorb and transmit longitudinal stresses in a mass of cast high explosive in order to reduce the chance of premature explosive of the high explosive.

It is a further object of the invention to permit the use of higher launch accelerations and/or more sensitive and powerful explosive grain in gun-launched projectiles.

It is a further object of the present invention to provide an axial reinforcement of a high explosive grain in a gun-launched projectile.

According to an aspect of the invention, there is provided a high explosive grain for a projectile of the type having a casing comprising a mass of high explosive in the casing, a plurality of longitudinal reinforcement members in the mass of high explosive, means for transferring at least part of stresses in the mass of high explosive to the longitudinal reinforcement members, and means for transferring at least part of stresses in the longitudinal reinforcement members to the casing whereby a tendency for premature explosion of the explosive grain due to high acceleration is reduced.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a longitudinal cross section of a gun-launched projectile containing a reinforced high explosive grain according to an embodiment of the invention;

FIG. 2 is a cross section along II—II of FIG. 1;

FIG. 3 is a cross section similar to FIG. 2 except employing longitudinal reinforcement members having lumps or balls thereon; and FIG. 4 is a cross section taken along IV—IV of FIG. 1.

DETAILED DESCRIPTION OF THE PREFERRED EMBODIMENTS

Referring now to FIG. 1, there is shown a projectile 10 such as, for example, an artillery shell containing a reinforced high explosive grain 12 according to an embodiment of the present invention.

Projectile 10 includes a generally cylindrical casing 14 having an ogive-shaped forward end 16 terminating in a fuse well 18 which is conventionally threaded to receive a fuse mechanism (not shown) therein. The rear end 20 of casing 14 may be closed as shown and its interior surface may be hemispherical for distribution of the thrust forces from casing 14 into explosive grain 12.

Reinforced high explosive grain 12 consists of a mass of cast high explosive 22 containing a plurality of longitudinal reinforcement members 24 extending through cast high explosive 22 and resting on rear end 20. It will be noted that longitudinal reinforcement members 24 are shown straight, parallel and extending forward only as far as the rear of ogive-shaped forward end 16. None of these conditions is necessary for successful employment of the invention. Instead, longitudinal reinforcement members 24 may be curved or inclined with respect to the longitudinal axis indicated by arrow 26 and may extend through the complete length of cast high explosive 22.

Referring to FIG. 2 longitudinal reinforcement members 24 are relatively rigid compared to cast high explosive 22. Cast high explosive 22 may adhere to the surface of longitudinal reinforcement members 24 purely by friction or by other means, and the longitudinal launch forces on cast high explosive 22 are transferred to longitudinal reinforcement members 24 from whence they are, in turn, transferred to rear end 20 (FIG. 1).

Sufficient friction to transfer stresses may be generated by the existence of a friction coefficient between cast high explosive 22 and longitudinal reinforcement members 24 and the intimate contact therebetween resulting from residual manufacturing stress, initial thermal stresses and lateral stresses due to the confined Poisson effect produced by the presence of longitudinal reinforcement members 24 and the accompanying longitudinal axial stresses thereof.

If additional force transfer between cast high explosive 22 and longitudinal reinforcement members 24 is required beyond that which can be accomplished by frictional contact alone, additional means may be employed such as shown in FIG. 3 for coupling forces from cast high explosive 22 to especially shaped longitudinal reinforcement members 24'. Longitudinal reinforcement members 24' are shown to include protuberances such as lumps or balls 28 rigidly affixed at periodic intervals thereon to provide an area mismatch which resists axial translation of cast high explosive 22 with respect to longitudinal reinforcement members 24'. Instead of lumps or balls 28, other area mismatch techniques may be employed such as the use of transverse plates (not shown) either integrally formed with, or permanently affixed to longitudinal reinforcement members 24. In addition, a positive taper (not shown) may be employed expanding from front to rear. Further, the surfaces of longitudinal reinforcement members 24 (FIG. 2) and 24' (FIG. 3) may be roughened, or have a friction-inducing layer applied thereon.

Referring again to FIG. 1, it is preferred that longitudinal reinforcement members 24 be inserted through fuse well 18 before casting high explosive 22. This may require a structure (not shown) to temporarily support longitudinal reinforcement members 24 in proper relative relationships prior to their being supported by cast high explosive 22.

Referring now to FIG. 4, additional measures may be necessary to absorb at least part of the axial stresses in cast high explosive 22 in a manner which goes beyond merely coupling these stresses directly from longitudinal reinforcement members 24 to rear end 20 of casing 14. In order to ensure that only low axial stresses occur in cast high explosive 22, it may be necessary to incorporate a matrix stress decoupling layer 30 which is softer than or has a modulus substantially lower than, cast high explosive 22 and which has sufficient thickness to ensure stress decoupling. Although any suitable material may be used in decoupling layer 30, the material used should not contain air or be of a material that produces significant heat under the imposed compression loads.

Although the inclusion of longitudinal reinforcement members 24 in reinforced high explosive grain 12 somewhat reduces the final amount of explosive available to be detonated, this effect can be counterbalanced by appropriate choice of material from which at least some of longitudinal reinforcement members 24 are produced. For example, if some or all of longitudinal reinforcement members 24 are produced from pyrophoric materials such as a suitable aluminum alloy, the resulting incendiary effects may enhance sufficiently terminal destructiveness of the high explosive alone that the slight reduction in high explosive content is more than compensated.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A high explosive grain for an artillery projectile of the type having a casing comprising:

a solid mass of high explosive in said casing;

a plurality of longitudinal reinforcement members in said mass of high explosive;

means for transferring at least part of stresses in said mass of high explosive to said longitudinal reinforcement members; and means for transferring at least part of stresses in said longitudinal reinforcement members to said casing whereby a tendency for premature explosion of the explosive grain due to high acceleration is reduced; wherein said plurality of longitudinal reinforcement members includes a plurality of straight rods forming a matrix parallel to an axis of application of said high acceleration; and said means for transferring includes protuberances rigidly affixed to said longitudinal reinforcement members.

2. A high explosive grain for a projectile according to claim 1 wherein at least some of said longitudinal reinforcement members are of pyrophoric material.

3. A high explosive grain for a projectile according to claim 1 further comprising a stress decoupling layer in said casing said stress decoupling layer being softer than said high explosive and being effective to structurally decouple stress between said high explosive and said casing.

* * * * *